United States Patent [19]

Ribaudo, Jr.

[11] Patent Number: 4,515,307

[45] Date of Patent: May 7, 1985

[54] HOT WATER CONTROL SYSTEM

[76] Inventor: Andrew Ribaudo, Jr., 1213 Hyman Ave., Bay Shore, N.Y. 11706

[21] Appl. No.: 560,244

[22] Filed: Dec. 12, 1983

[51] Int. Cl.[3] ..... F22B 27/00; F24D 3/08

[52] U.S. Cl. ..... 236/25 R; 237/19; 165/40

[58] Field of Search ..... 237/19, 8 R; 236/24.5, 236/25 R, 26 R; 126/362; 122/17; 165/39, 40

[56] References Cited

U.S. PATENT DOCUMENTS

| | | | |
|---|---|---|---|
| 2,345,277 | 3/1944 | McGrath | 237/8 C |
| 2,515,885 | 7/1950 | Midyette | 237/8 R |
| 4,275,709 | 6/1981 | Barcelo Rubi | 237/8 C |

FOREIGN PATENT DOCUMENTS

| | | | |
|---|---|---|---|
| 1954962 | 6/1970 | Fed. Rep. of Germany | 237/8 C |

*Primary Examiner*—Henry Bennett

*Attorney, Agent, or Firm*—Alfred M. Walker

[57] ABSTRACT

A hot water control system, for providing unlimited domestic hot water upon demand and for conserving fuel, comprises first temperature control means responsive to temperature in the input conduit to a boiler for controlling the firing of the boiler, and diverting means responsive to changes in demand for diverting hot water from the output conduit of the boiler to the input conduit, in order to continue firing of the boiler when demand is reduced, and to delay firing of the boiler when demand is increased, so that the heat of previously heated water can be used.

4 Claims, 1 Drawing Figure

HOT WATER CONTROL SYSTEM

BACKGROUND OF THE INVENTION

Conventional domestic heating systems typically have an aquastat for controlling the firing of a boiler in response to a range of temperature sensed by a probe placed in the vicinity of the boiler jacket. The boiler is generally fired when the probe senses a low point of the temperature range, such as 160° F., and shuts off when the probe senses a high temperature, such as 180° F., regardless of the actual demand. For example, if hot water is needed for domestic uses, the boiler will fire at 160° F., raise the temperature to 180° F., and then shut off. The temperature of the water will drop off until it reaches 160° F., at which time the boiler is refired. Such conventional systems require overcompensation in that they expend more heat than is necessary to heat water to meet demand at a desired temperature.

The location of the aquastat probe in the vicinity of the boiler results in repeated refiring of the boiler as the water temperature fluctuates within the given temperature range due to hot water demand. Even after hot water demand is terminated, the system may continue to fire without discrimination until the high temperature level is reached, which mitigates against efficient heating. Such systems must continuously regenerate hot water at the low point of the temperature range and continue firing until the high point is reached, regardless of the actual demand for hot water.

SUMMARY OF THE INVENTION

The invention provides a hot water control system for supplying domestic hot water on demand while conserving fuel. It has application to conventional heating systems, including systems which provide heat for both space heating and domestic hot water needs. The system has first temperature control means responsive to temperature in the input conduit to the boiler for controlling the firing of the boiler, in combination with diverting means responsive to changes in demand for diverting hot water from the output conduit of the boiler to the input conduit. The control and diverting means operate to continue firing the boiler when demand is reduced, and to delay firing of the boiler when demand is increased, so that the heat of previously heated water can be used.

In a preferred embodiment, the first temperature control means is an aquastat having a temperature probe located in the cold water input conduit at a first location, and the diverting means includes a bypass conduit and pump for diverting hot water from the hot water output conduit to a confluence point between the first location and an upstream cold water input source. The diverting means operates in response to pressure and temperature sensors which detect changes in demand. A preferred location for the pressure sensor is in the hot water output conduit and, for the temperature sensor, in the cold water conduit between the confluence point and the cold water input source. The invention also encompasses a recirculation conduit and mixing valve from the hot water output conduit to the cold water input conduit upstream of the cold water input source for utilizing the heat of the hot water to preheat the cold water.

An essential feature of the invention is that it operates primarily only upon actual demand for hot water. Further, the system delays shutting off the boiler upon detecting a drop off in demand, and delays firing of the boiler at the onset of increased demand, in order to utilize and recapture the heat of previously heated water. The invention eliminates the need to maintain water temperature at high levels when it is not needed. Due to the mixing of hot water with cold water and the location of the aquastat probe in the input conduit, the boiler is kept on during periods of demand. Thus, the need for constant refiring and turning off of the firing mechanism is avoided, and fuel is additionally conserved.

DETAILED DESCRIPTION OF THE INVENTION

Figure 1:
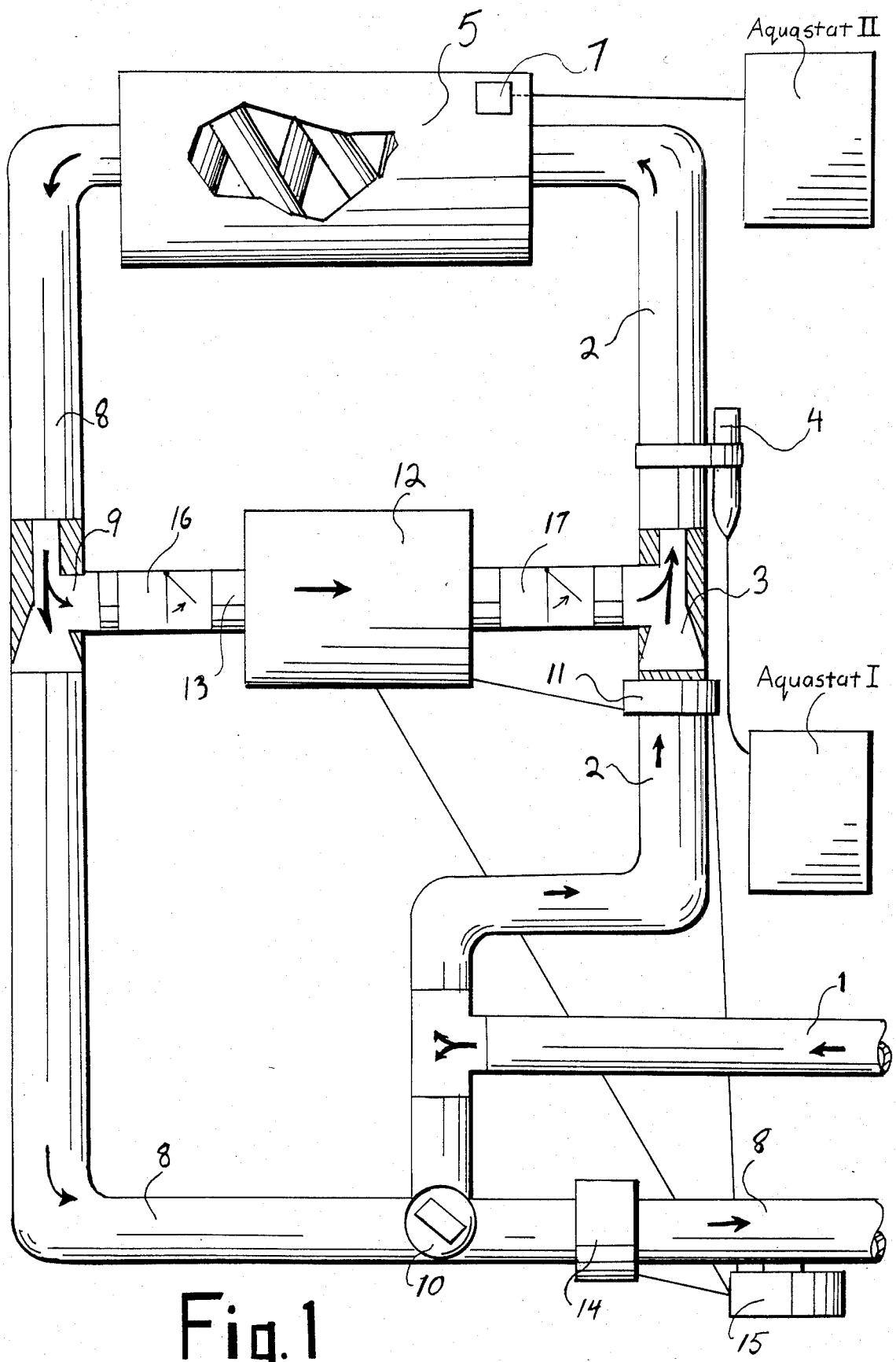

The above and further elements, features, and advantages of the invention are described below, in conjunction with the drawing, in which FIG. 1 is a schematic diagram of the hot water control system of the invention. Although preferred embodiments of the invention are described, it is intended that such description not limit the scope of the invention.

In FIG. 1, water is introduced from an external source 1, typically the cold water inlet. The water enters at a temperature equivalent to the conditions of the external source, normally about 60° F. The water is channelled into input conduit 2 to a boiler 5 where it is heated and passed to output conduit 8 for domestic uses. A bypass conduit 13 is arranged to divert water under certain conditions, described in further detail below, from the hot water output conduit 8 to the cold water input conduit 2. At both points of juncture 9 and 3, respectively, as shown in the drawing, flow tee valves are provided to enhance the diversion of water when necessary for the operation of the system. The effect of the flow tee valve at position 3 is also to accelerate the circulation of water flowing through conduit 2, referred to as a Venturi effect. The accelerated circulation eliminates the need for artificial propulsion at this point in the system.

The temperature of the water flowing past position 3 is monitored by probe 4, which is in communication with a temperature control mechanism, designated Aquastat I, which turns boiler 5 on in accordance with a preset low temperature limit. In a preferred embodiment, for example, Aquastat I can be set to turn the boiler on when the water passing probe 4 is less than 140° F.

Another part of Aquastat I may also be used to control the supply of hot water between a hot water circulation system for space heating and hot water output for current domestic demand. Thus, for example, during periods of high demand, Aquastat I may be used to cut off hot water supply for space heating and direct all of the hot water output for domestic uses when continued firing of the boiler results in a temperature at probe 4 no higher than 120° F. It is to be understood that such a space heating system is separate from the operation of the hot water system for domestic demand described herein, and is not shown in the drawing or described further other than for the common sharing of boiler 5 as a heat source.

Probe 7 forms a second temperature control system, designated Aquastat II, and is located in boiler 5 for purposes of guaranteeing the safe operation of the system against production of excessively hot water. For example, Aquastat II can be set to turn off boiler 5 when the temperature of water in the boiler jacket reaches a high limit of 210° F.

Hot water emerging from boiler 5 enters output conduit 8 and is channelled past flow tee 9 downstream for domestic use. Mix valve 10 is provided for controlling the mix of hot water into cold water input conduit 2. In the event demand ceases, the hot water is redirected at mix valve 10 into input conduit 2 at a point upstream of the inlet from external source 1. The mixture of redirected hot water and the cold input water then continues the process described hereinbefore.

Sensing device 11, preferably in the form of a thermodisc, is provided to monitor the temperature of water in the input conduit 2 consisting of the cold input water mixed with the redirected hot water under conditions of low or no demand. In the event the temperature detected by sensing device 11 is less than a predetermined lower temperature, for example 80° F., then the device 11 causes the actuation of pump 12 for diverting hot water through bypass conduit 13. The diverted water is pumped to position 3 where it mixes with the water in conduit 2 immediately preceding the location of probe 4. Sensing device 11 is also used to terminate the operation of the pump when the temperature detected is more than a predetermined upper temperature, for example 100° F. Check valves 16 and 17 are provided to ensure that the flow of water through bypass conduit 13 is in one direction only.

Preferably, the diversion of hot water through bypass conduit 13 is also governed by the volume of demand for hot water, as measured by pressure sensor switch 15 located downstream of pressure regulator 14. Upon detection of a predetermined pressure level indicating an increase in demand, the switch 15 activates pump 12 to divert hot water from position 9 into bypass conduit 13. This diversion of hot water to the vicinity of the probe 4 serves to delay the firing the boiler upon an increase in demand for a short time in order to utilize the hot water still in output conduit 8.

Upon a predetermined pressure level indicating a decrease in demand, switch 15 terminates operation of pump 12. Without the diversion of hot water to the vicinity of the probe 4, the boiler continues firing for a period of time after detection of the drop in demand, thereby avoiding the constant off and on firing of the boiler, as occurs in conventional systems. Fuel is thus conserved or utilized more efficiently. Also, a principal feature of this invention is that it functions in direct response to the conditions of demand, and the diversion of hot water to the cold water input conduit is governed both by variations in the temperature of circulating water as well as in the pressure generated by domestic demand or the lack thereof.

The advantageous operation of the described system is as follows. A decrease in demand sensed by pressure sensor switch 15 turns off pump 12, leaving the remaining hot water output for domestic use. The boiler 5 continues to fire as long as the temperature of the water passing probe 4 remains below 140° F. The boiler is therefore kept on until the demand is met.

A further feature of the invention is the delayed turning on of the boiler, which conserves fuel by permitting the hot water remaining in the system to be utilized and/or having its heat recaptured. When demand is increased, the sensing device 11 causes pump 12 to divert hot water from the output conduit, resulting in delayed firing of the boiler until the temperature of the water past probe 4 is less than 140° F.

Although the invention has been described with respect to the above specified elements and parameters of a preferred embodiment, it is to be understood that many possible variations may be made within the spirit and scope of the invention. All such variations are intended to be encompassed within the invention, as defined in the following claims.

I claim:

1. A control system for a domestic hot water heating system having an input conduit, a cold water source to said input conduit, an output conduit, and a heating unit for heating water from said input conduit and providing hot water to said output conduit, a bypass conduit for the diversion of hot water from said output conduit to said input conduit, a first temperature detecting means located in said input conduit downstream from said bypass conduit connected to a mechanism for turning on and off said heating unit in response to detection of a predetermined first temperature level, a diverting means for diverting hot water from the output conduit, through the bypass conduit to the input conduit, a pressure switch located in said output conduit for detecting a first predetermined pressure level indicating a low demand for hot water from said output conduit.

2. The control system of claim 1, wherein said pressure switch is arranged to detect a second predetermined pressure level indicating a high demand for hot water, and said diverting means is responsive thereto for initiating diversion of hot water through said bypass conduit.

3. The control system of claim 2, wherein a second temperature detecting means is located in said input conduit upstream from said bypass conduit and downstream from said cold water source connected to a mechanism for turning on and off a means for diverting water through the bypass conduit in response to detection of a second predetermined temperature level in said input conduit.

4. The control system of claim 3, wherein said temperature sensor is arranged to detect a predetermined second high temperature, and said diverting means is responsive thereto for terminating diversion of hot water through said bypass conduit.

* * * * *